US007199316B2

(12) United States Patent
Gorrie et al.

(10) Patent No.: US 7,199,316 B2
(45) Date of Patent: Apr. 3, 2007

(54) MULTIFUNCTION SWITCH FOR OPERATING A DEVICE IN A SEALED CONTAINER

(75) Inventors: Joseph E. Gorrie, Klingerstown, PA (US); Brian E. Probst, Renovo, PA (US)

(73) Assignee: W.T. Storey, Inc., Dalmatia, PA (US)

( * ) Notice: Subject to any disclaimer, the term of this patent is extended or adjusted under 35 U.S.C. 154(b) by 314 days.

(21) Appl. No.: 10/938,333

(22) Filed: Sep. 10, 2004

(65) Prior Publication Data

US 2006/0054480 A1 Mar. 16, 2006

(51) Int. Cl.
*H01H 35/02* (2006.01)

(52) U.S. Cl. ..... 200/61.45 M; 200/541

(58) Field of Classification Search ..... 200/61.45 M, 200/291, 541, 547, 550, 548, 404, 84 C, 200/60, 332.2; 362/202, 205, 208, 157, 187, 362/188, 398, 421, 427; 335/205–207
See application file for complete search history.

(56) References Cited

U.S. PATENT DOCUMENTS 3,794,825 A * 2/1974 Krupansky ..... 362/158
3,800,249 A * 3/1974 Bury ..... 335/2
4,152,755 A * 5/1979 Trosper et al. ..... 362/158
4,533,982 A * 8/1985 Kozar ..... 362/183
4,739,457 A * 4/1988 Orr ..... 362/287
4,926,172 A * 5/1990 Gorsek ..... 341/20
6,547,414 B2 * 4/2003 Steger ..... 362/188
6,625,556 B1 * 9/2003 Conboy et al. ..... 702/84
6,626,556 B2 9/2003 Galli
6,730,864 B2 * 5/2004 Hillebrand et al. ..... 200/61.88
6,893,141 B2 * 5/2005 Mah ..... 362/192
6,904,823 B2 * 6/2005 Levin et al. ..... 74/471 XY
6,922,123 B2 * 7/2005 Lalonde et al. ..... 335/207
2003/0106782 A1 * 6/2003 Galli ..... 200/6 A
2003/0230470 A1 * 12/2003 Galli ..... 200/60
2004/0008510 A1 * 1/2004 Mah ..... 362/192

* cited by examiner

*Primary Examiner*—Kyung S Lee
*Assistant Examiner*—Lisa Klaus
(74) *Attorney, Agent, or Firm*—Thomas R. Shaffer

(57) ABSTRACT

A multifunction switch for operating a device in a sealed container such as a flashlight includes at least one reed switch mounted at a location on an inner surface of the sealed container. A base plate is provided on an outer surface of the sealed container which has at least three detents. A sliding switch plate having an inner surface is juxtaposed with the outer surface of the base plate. The sliding switch plate inner surface has a securing device for removably securing and retaining the sliding switch in a desired position when the securing device is received by one of the detents. The sliding switch inner surface has at least one magnet mounted therein which operates one or more reed switches when at least one magnet slides over the location of the reed switch. A perimeter face plate is attached to the base plate to hold the sliding switch plate onto the base plate.

18 Claims, 6 Drawing Sheets

MULTIFUNCTION SWITCH FOR OPERATING A DEVICE IN A SEALED CONTAINER

BACKGROUND OF THE INVENTION

1. Field of the Invention

The present invention relates to a multifunction switch for operating a device in a sealed container. More specifically, it relates to a sealed container (such as a flashlight, for example) which has one or more reed switches positioned inside the flashlight housing and a magnet switch positioned outside the housing which may be selectively moved between an "off" position and at least two functionally different "on" positions.

2. Description of the Prior Art

Various attempts have been made to provide a completely waterproof switching for a flashlight by fully integrating such mechanism into the flashlight head. Galli, U.S. Pat. No. 6,626,556, for example, provides a complex switching mechanism that is designed to operate in a reverse direction making electric contact as the flashlight head is unscrewed. Such an arrangement is believed to be unreliable in terms of making a connection and in terms of maintaining a truly sealed container.

A superior method is the use of a magnetic reed switch. It has long been known to utilize a reed relay switch on the interior of a waterproof flashlight housing in combination with a magnet switch on the outside of such housing to turn on a flashlight without the need to pierce the housing. Krupansky, U.S. Pat. No. 3,794,825, is an example of such a flashlight wherein a moveable magnetic element is mounted to overlie a reed relay switch and is adapted to be reciprocated between an on and an off position by a thumb button.

While the Krupansky device provides an effective manner to turn a sealed waterproof flashlight on and off without piercing the housing, emergency workers, fire fighters, police, military and others sometimes require a flashlight to perform multiple functions such as a steady on function, an off function and a momentary on function for signalling purposes. Additional functions such as a periodic flashing function (with any of a number of desired flashing patterns) may also be desired.

There remains a need for a flashlight or other sealed container which allows activation of multiple functions by manipulation of a single movable switch member.

SUMMARY OF THE INVENTION

The present invention provides a multifunction switch for operating a device in a sealed container comprising at least one reed switch mounted at a location on an inner surface of said sealed container; a base plate provided on an outer surface of said sealed container, said base plate having at least three detents; a sliding switch plate having an inner surface juxtaposed with said outer surface of said base plate, said sliding switch plate inner surface having a securing means for removably securing and retaining said sliding switch in a desired position when said securing means is received by one of said detents, said sliding switch inner surface having at least one magnet mounted therein which operates said at least one reed switch when said at least one magnet slides over said location of said at least one reed switch; and a perimeter face plate attached to said base plate to hold said sliding switch plate onto said base plate.

Preferably, at least one of said at least three detents is elongated and forms a groove.

Preferably, said securing means guides said sliding switch plate along a desired path when said securing means is received by said groove.

Preferably, said securing means is a spring loaded retractable ball extending inwardly from said inner surface.

Preferably, a coil spring is connected between a first coil spring connection point on said base plate and a second coil spring connection point on said sliding switch plate. Said spring preferably exerts a force less than needed to cause said sliding switch to move when said ball is in one of said detents, but sufficient to bias said sliding switch to a desired groove end position when said ball is received by said groove and no external force is imparted upon said sliding switch plate. With this arrangement, said sliding switch plate may be manually moved to any detent, which detent will hold said switch at such detent position and said sliding switch plate may be manually moved from any detent to said groove, which groove allows said sliding switch plate to be manually moved in said groove to an opposite groove end position and is spring loaded to return to said desired groove end position when no external force is imparted.

Preferably, said securing means is a protrusion adapted to be removably received by said detents. In one embodiment, said protrusion is generally hemispherical in shape. In a preferred embodiment of the invention, at least one of said detents is generally hemispherical in shape.

Preferably, at least one of said detents is not colinear with at least two other detents.

Preferably, a single reed switch is provided and at least two of said detents are positioned at least partially over said single reed switch. This allows for a steady on function and a momentary on function.

In one embodiment, two separate reed switches are provided and at least one of said detents is positioned over each of said two reed switches, wherein each reed switch performs a different function, such a steady on function or a flashing function, for example.

Preferably, said detents are concave and said securing means is convex. Alternatively, the device may also be designed such that said detents are convex and said securing means is concave.

While the multifunction switch of the present invention is specifically designed for use with a sealed flashlight, it may be utilized in combination with any sealed container. The switch of the present invention might, for example, be utilized in any environment application where an explosive gas or flammable material is present and where the arc that occurs from opening or closing a switch might cause a problem. The switch could also be used in wet locations where electrical shock might present a danger. By way of further examples, a sealed container might contain an audible alarm or even an underwater explosive device or any device which may need to be kept in a waterproof container but which may need to be operated in a multifunction mode. With these examples, an alarm might sound and the device might detonate immediately or with a delay depending upon which function is chosen with the switch.

DETAILED DESCRIPTION OF THE PREFERRED EMBODIMENTS

Figure 3:
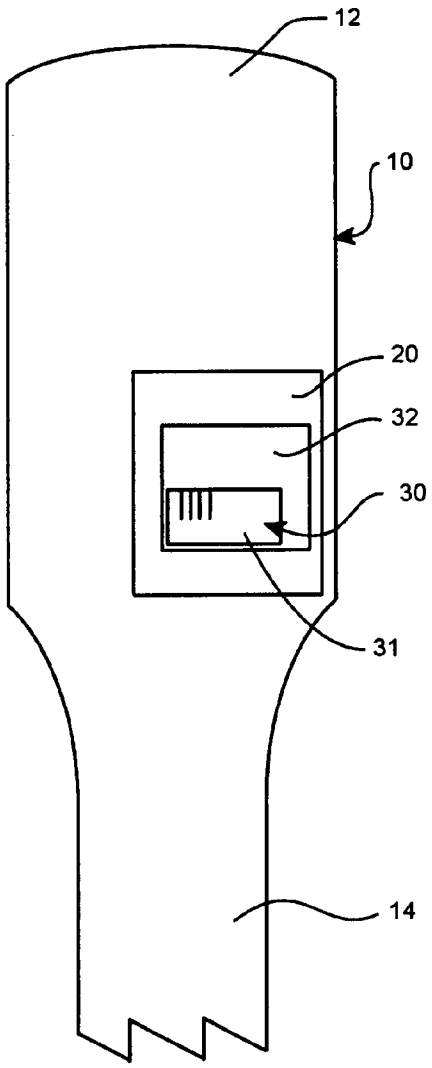
FIG. 3 is a top plan view of the switch of the present invention spring biased to a temporary off position.

Referring to FIGS. 1–4, a flashlight 10 is shown which has a flashlight head 12 and a handle portion 14. The flashlight head 12 has a flat surface or base plate 60 (FIG. 5) onto which a sliding switch plate 30 is mounted. The upper surface 32 of the sliding switch plate 30 has an elevated thumb switch 31 which is adapted to be moved by the thumb T of a user. The sliding switch plate 30 is held onto the flat surface or base plate 60 by means of a perimeter plate 20. The perimeter plate 20 holds the sliding switch plate 30 in a manner which allows the sliding switch plate 30 to move not only forward and backward but also left and right. When the thumb switch 31 is moved to the position shown in FIG. 1, that is the lower right hand position, the flashlight is in a fully off position. When in this position as will be explained in greater detail hereinafter, a spring loaded ball member 40 (FIG. 6) is engaged into a detent 62 (FIG. 5).

Figure 2:
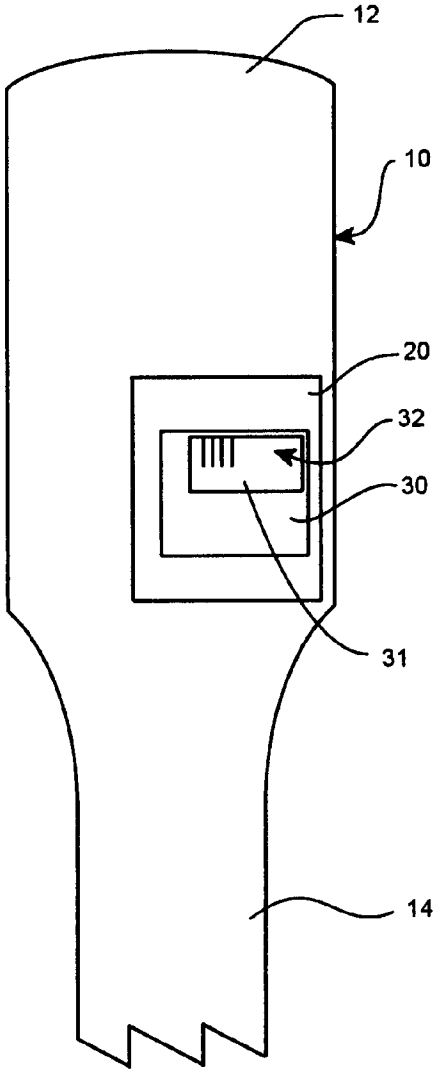
FIG. 2 is a top plan view of the switch of the present invention in a fully on position.
Figure 1:
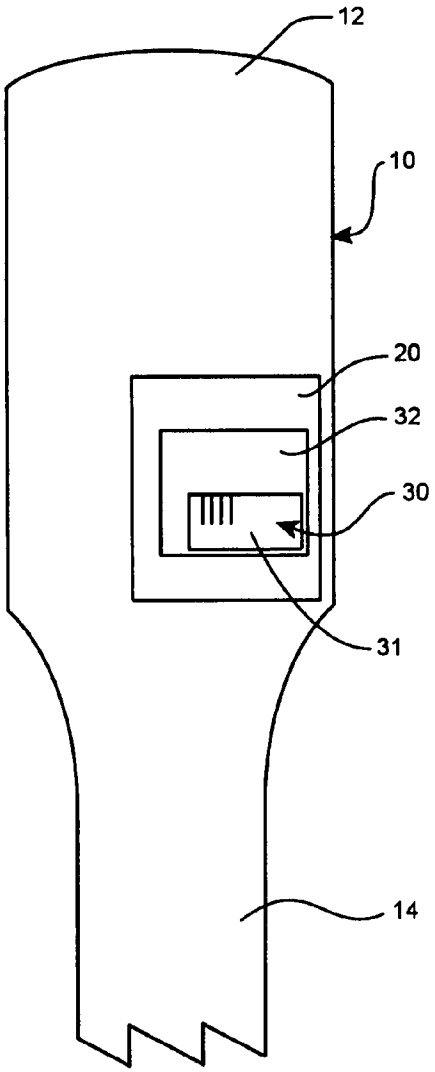
FIG. 1 is a top plan view of the switch of the present invention in a fully off position.

Referring to FIG. 2, when the thumb switch 32 is moved to the upper right position as shown, the flashlight is in a fully on position. In this position, the spring loaded ball 40 (FIG. 6) is retained by detent 64 (FIG. 5).

Referring to FIG. 3, when the thumb switch 30 is manipulated to the lower left hand position as shown, the flashlight is in a temporary off position and is so held by means of a spring member 50 (FIG. 6) which will be described in greater detail hereinafter. In this position, the spring loaded ball 40 (FIG. 6) is located in end 65 of elongated detent 66. It is noted that detent 66 is elongated and forms a groove having a first end 65 and a second end 67.

Figure 4:
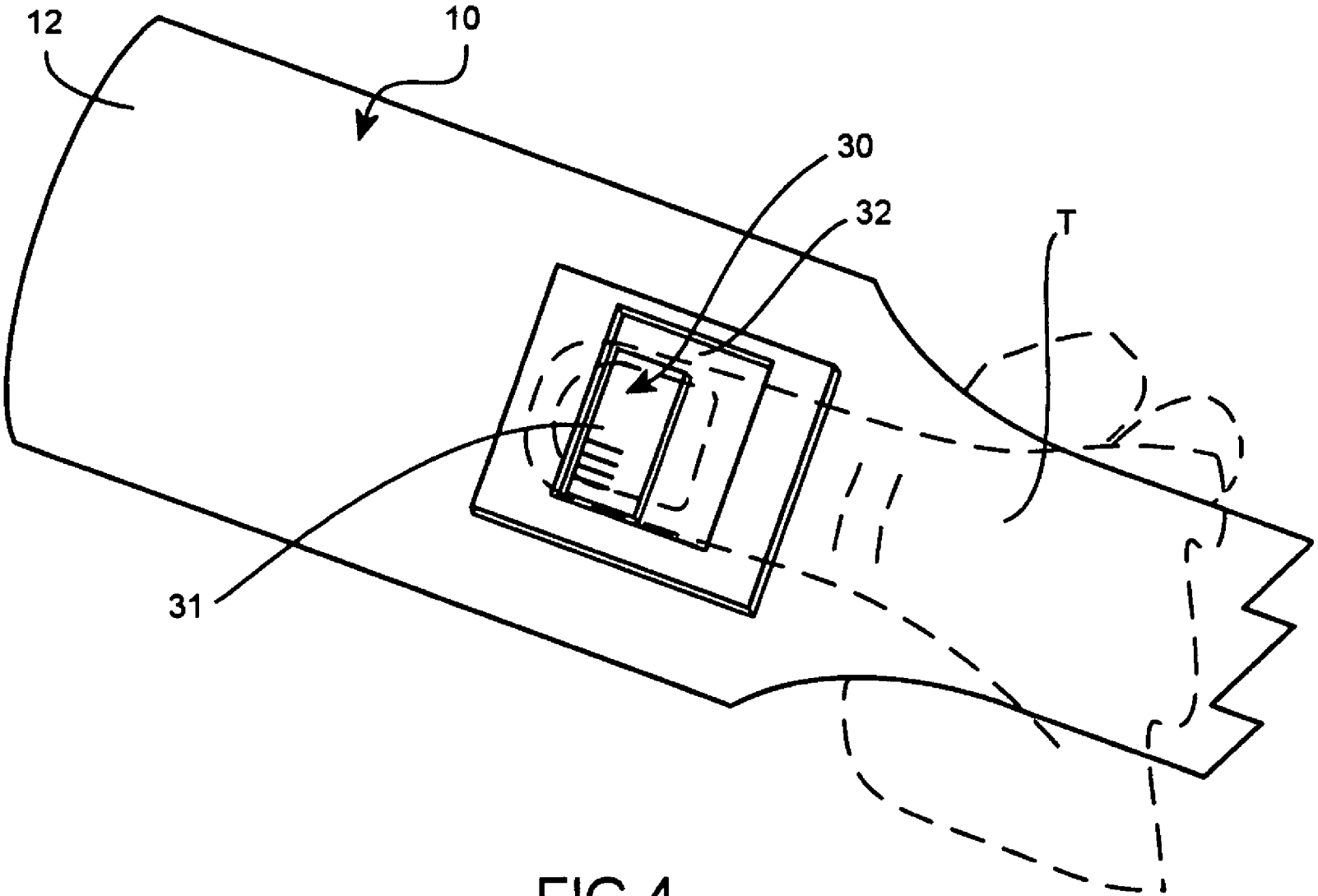
FIG. 4 is a perspective view of the switch of the present invention being pushed by a thumb T to a momentary on position.
Figure 5:
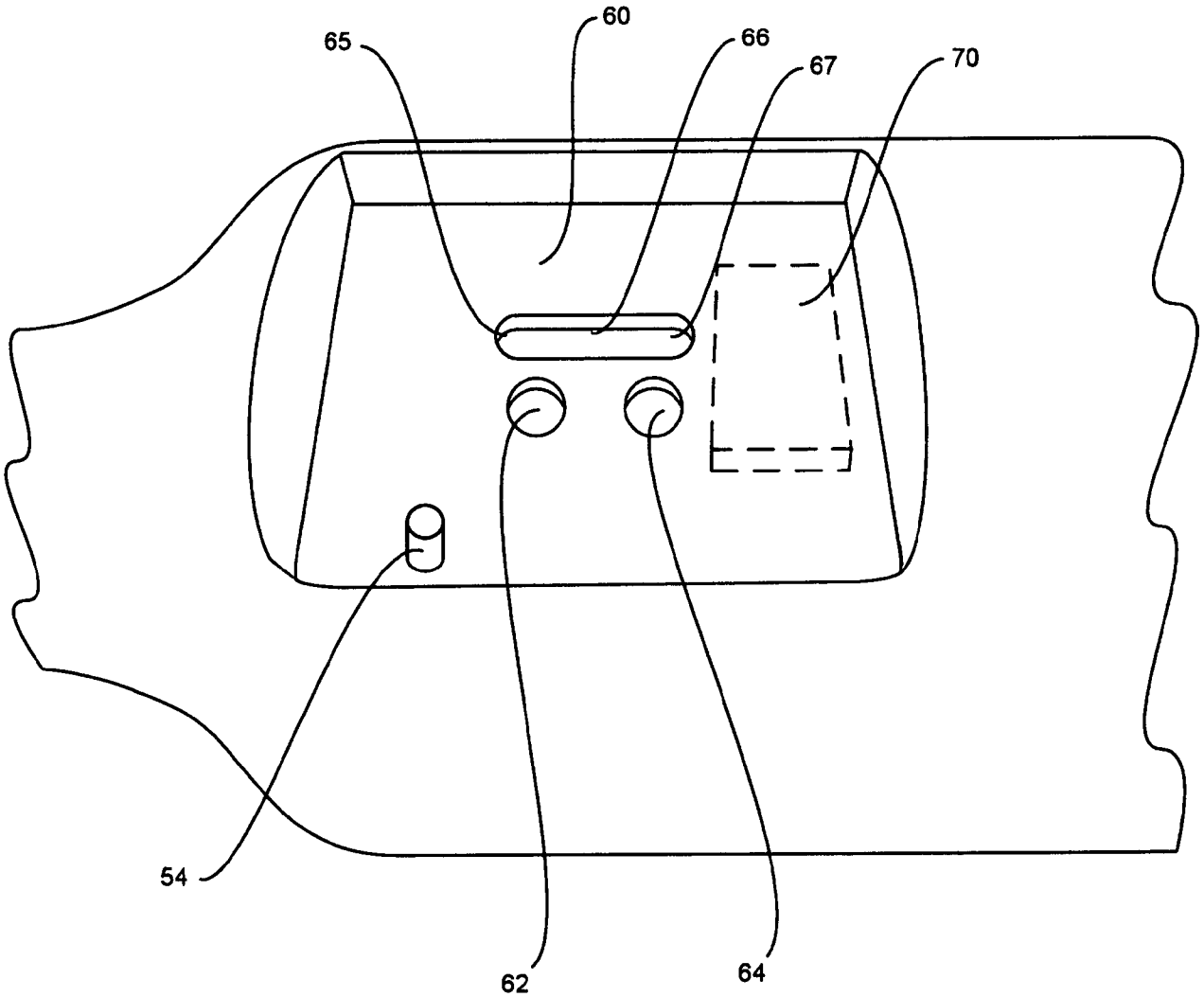
FIG. 5 is a perspective view of an outer surface of the flashlight head showing the location of the detents.

Referring to FIG. 4, the flashlight is shown with a user's thumb T pushing the thumb switch 31 to the upper left position which is a momentary on position. This position is utilized for signaling. In this position, the spring loaded ball 40 is located at end 67 of elongated detent 66. In this position, when the thumb T is released from the thumb switch 31, the sliding switch plate 30 will return to the position of FIG. 3 by means of spring 50.

Referring now to FIG. 5, it can be seen that the flashlight head 12 includes a base plate or flat surface 60 which includes detents 62, 64 and 66. Detents 62 and 64 are generally circular or hemispherical and detent 66 is elongated in the form of a groove having a first end 65 and a second end 67. Base plate 60 also includes a post member 54. A magnetic reed switch 70 is provided as shown in FIG. 5 on the underside of the upper surface 60. It will be obvious to those of skill in the art that the location of the reed switch 70 need not be directly under the detents 64 and 66 but rather may also be spaced from the detents so long as the magnetic field of the magnet 80 passes close enough to the reed switch 70 to activate the same when the thumb switch 31 is moved to an on position.

Figure 6:
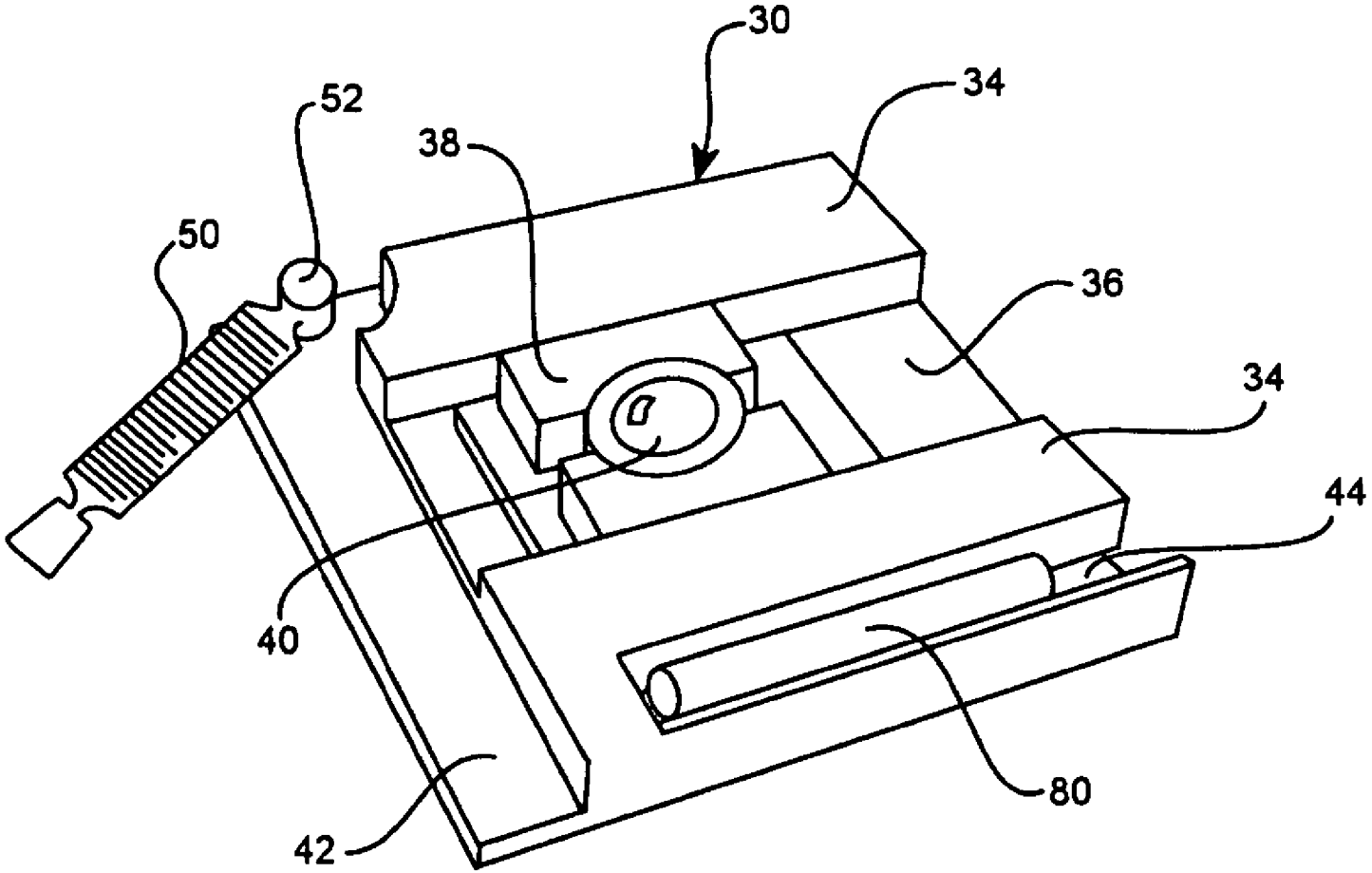
FIG. 6 is a perspective view of a lower surface of a sliding switch plate of the present invention.

Referring to FIG. 6, the lower surface of the sliding switch plate 30 is shown. The switch plate 30 has a generally flat lower surface 34. A first recess 36 is provided through a central portion of the sliding switch plate 30 into which a block member 38 is mounted. Block member 38 is utilized to secure and place a spring loaded ball member 40. While it is preferred to utilize a spring loaded ball member, any type of convex surface would function for this purpose.

The lower surface 34 has a second recess 42 provided along one edge onto which a post 52 is provided. Coil spring member 50 is provided which is attached at one end to post 52 and is attached at an opposite end to post 54 (FIG. 5). This spring 50 is utilized to bias the sliding switch plate 30 into the position shown in FIG. 4 when the ball member 40 is in the elongated detent or groove 66.

Lower surface 34 of the sliding switch plate includes a third recess 44 into which permanent magnet 80 is mounted. It will be obvious to those with skill in the art that when magnet 80 passes over the magnetic reed switch 70, the electric circuit is completed and the light will be turned to an on position.

Figure 7:
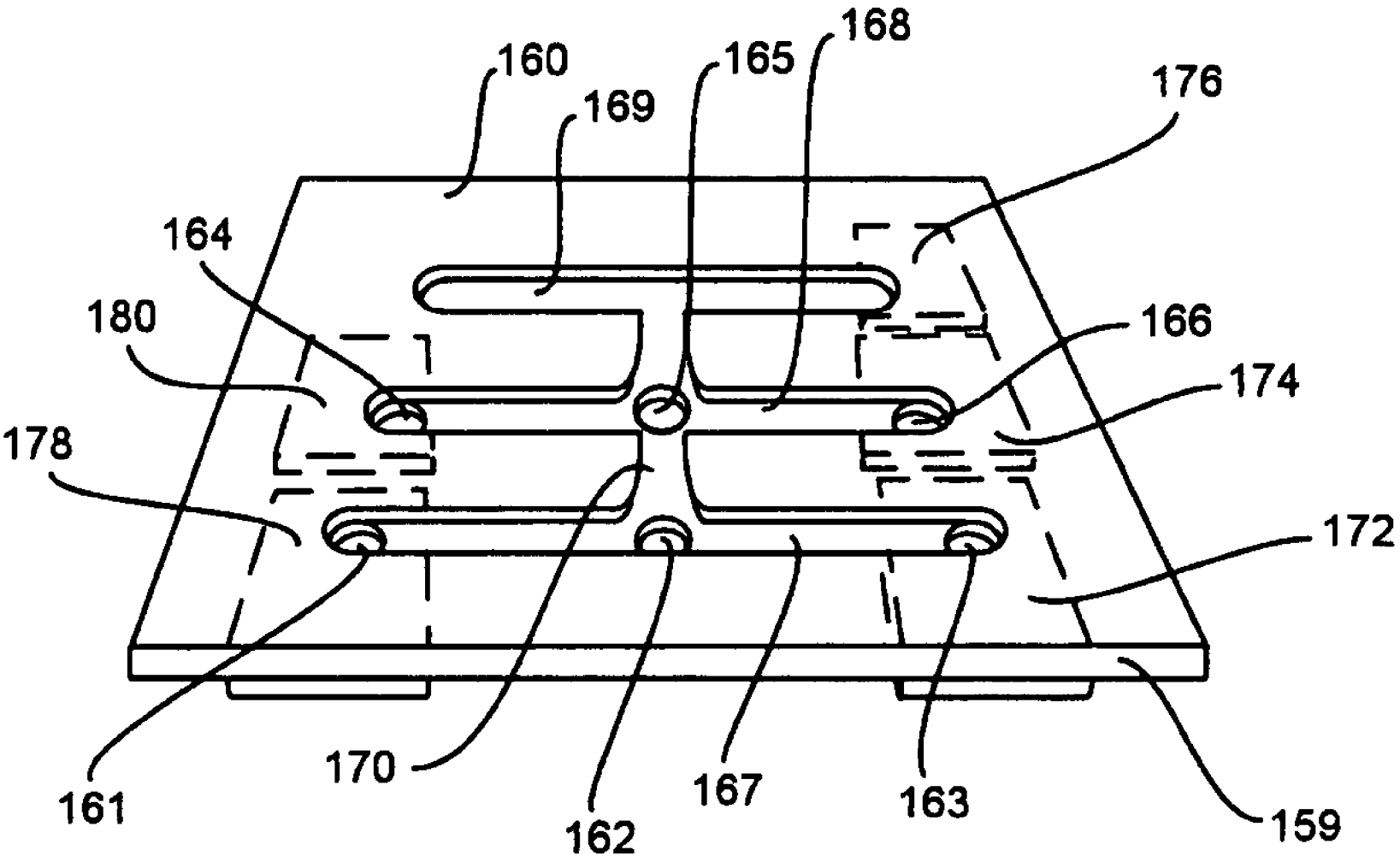
FIG. 7 is an alternative embodiment of the invention showing an alternative outer surface of the flashlight head showing more detents arranged in a modified "H" pattern to allow for more functions.

Referring to FIG. 7, an alternative embodiment of the invention is shown. In this embodiment, a number of detents, namely detents 161, 162, 163, 164, 165, 166 and 169 (which is an elongated detent) are shown. It is also shown in FIG. 7 that a detent can have both a groove 167 and a detent 163 which is embedded even deeper than the groove. While the switch would operate without the groove members 167, 168 and 170, such groove members may aid a user in keeping oriented as to where the switch is located. It will be obvious that the arrangement is similar to the gear shift on many standard motor vehicles.

In FIG. 7, a number of reed switches 172, 174, 176, 178 and 180 are provided. An arrangement as shown in FIG. 7 could be utilized to provide a greater number of functions than the switch shown in FIGS. 1–6. More specifically, if desired, the various magnetic reed switches could provide different intensities of illumination, various flashing patterns or could operate various other circuits unrelated to a flashlight such as an audio alarm, for example. In FIG. 7, the detents are provided on a base plate or flat surface 160. It can be seen that the various reed switches are mounted on the inner surface 159 of the container.

Figure 8:
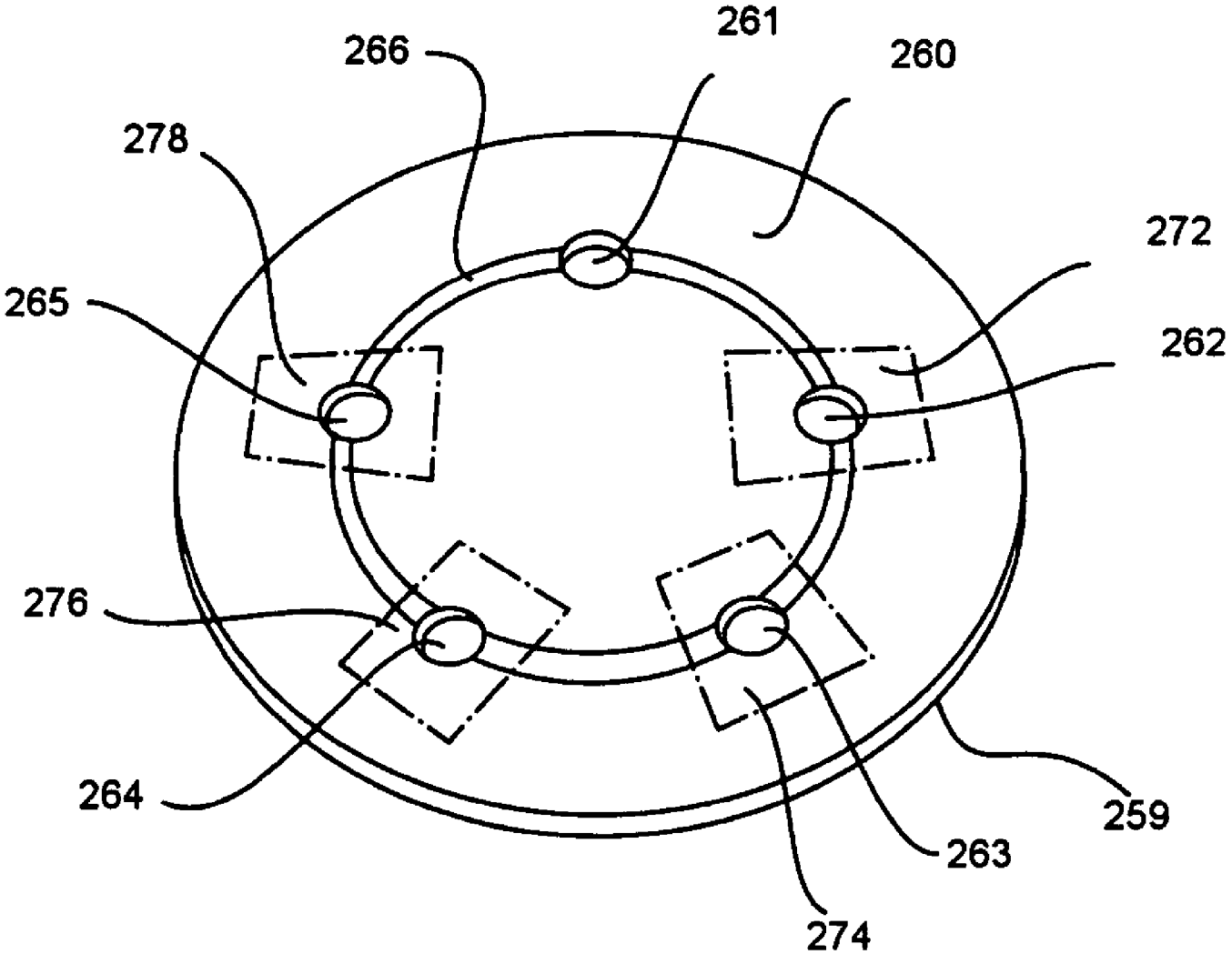
FIG. 8 is a second alternative embodiment of the invention showing the outer surface of the flashlight head with detents arranged in a generally circular pattern.

Likewise, FIG. 8 shows an alternative embodiment of the invention in which an upper surface or base plate 260 is provided and which has an inner surface 259 on which reed switches 272, 274, 276 and 278 are mounted. On the upper surface 260, detents 261, 262, 263, 264 and 265 are provided in a generally circular pattern. A groove 266 connects the various detents together making it easier for the user to remain oriented and to keep a ball member (such as ball 40 in FIG. 6) in a known and desired position.

From these examples, it will be obvious that a variety of patterns can be utilized for the switch of the present invention because the switch may move not only forward and backward but also side to side. This allows for countless geometric area patterns at which the various switch locations could be placed. Obviously, with the design of FIG. 7, the sliding switch plate would preferably have two permanent magnets, one at each end. In the embodiment in FIG. 8, a single magnet would suffice.

While we have shown and described the presently preferred embodiment of our invention, the invention is not limited thereto and may be otherwise variously practiced within the scope of the following claims.

We claim:

1. A multifunction switch for operating a device in a sealed container comprising:

a) at least one reed switch mounted at a location on an inner surface of said sealed container;

b) a base plate provided on an outer surface of said sealed container, said base plate having at least three detents;

c) a sliding switch plate having an inner surface juxtaposed with said outer surface of said base plate, said sliding switch plate inner surface having a securing means for removably securing and retaining said sliding switch in a desired position when said securing means is received by one of said detents, said sliding switch inner surface having at least one magnet mounted therein which operates said at least one reed switch when said at least one magnet slides over said location of said at least one reed switch; and d) a perimeter face plate attached to said base plate to hold said sliding switch plate onto said base plate.

2. A multifunction switch according to claim 1 wherein at least one of said at least three detents is elongated and forms a groove.

3. A multifunction switch according to claim 2 wherein said securing means guides said sliding switch plate along a desired path when said securing means is received by said groove.

4. A multifunction switch according to claim 1 wherein said securing means is a spring loaded retractable ball extending inwardly from said inner surface.

5. A multifunction switch according to claim 1 wherein at least one of said at least three detents is elongated and forms a groove, said securing means is a spring loaded retractable ball extending inwardly from said inner surface.

6. A multifunction switch according to claim 5 further comprising a coil spring connected between a first coil spring connection point on said base plate and a second coil spring connection point on said sliding switch plate.

7. A multifunction switch according to claim 6 wherein said spring exerts a force less than needed to cause said sliding switch to move when said ball is in one of said detents, but sufficient to bias said sliding switch to a desired groove end position when said ball is received by said groove and no external force is imparted upon said sliding switch plate.

8. A multifunction switch according to claim 7 whereby said sliding switch plate may be manually moved to any detent, which detent will hold said switch at such detent position, and said sliding switch plate may be manually moved from any detent to said groove, which groove allows said sliding switch plate to be manually moved in said groove to an opposite groove end position and is spring loaded to return to said desired groove end position when no external force is imparted.

9. A multifunction switch according to claim 1 wherein said securing means is a protrusion adapted to be removably received by said detents.

10. A multifunction switch according to claim 9 wherein said protrusion is generally hemispherical in shape.

11. A multifunction switch according to claim 1 wherein at least one of said detents is generally hemispherical.

12. A multifunction switch according to claim 1 wherein at least one of said detents is not colinear with at least two other detents.

13. A multifunction switch according to claim 1 wherein a single reed switch is provided and at least two of said detents are positioned at least partially over said single reed switch.

14. A multifunction switch according to claim 1 wherein two separate reed switches are provided and at least one of said detents is positioned over each of said two reed switches, wherein each reed switch performs a different function.

15. A multifunction switch according to claim 1 wherein said detents are concave and said securing means is convex.

16. A multifunction switch according to claim 1 wherein said detents are convex and said securing means is concave.

17. A multifunction switch according to claim 1 wherein said device is a flashlight.

18. A multifunction switch for operating a device in a sealed container comprising:

a) at least one reed switch mounted at a location on an inner surface of said sealed container;

b) a base plate provided on an outer surface of said sealed container, said base plate having at least two detents and having at least one groove in an outer surface thereof, said base plate also having a first coil spring connection point thereon;

c) a sliding switch plate having an inner surface juxtaposed with said outer surface of said base plate, said sliding switch plate inner surface having a spring loaded retractable ball extending inwardly from said inner surface, said ball adapted to removably secure and retain said sliding switch in a desired position when said ball is received by one of said detents and to guide said sliding switch plate along a desired path when said ball is received by said groove, said sliding switch inner surface having at least one magnet mounted therein which operates said at least one reed switch when said at least one magnet slides over the location of said at least one reed switch, said inner surface of said sliding switch plate having a second coil spring point thereon;

d) a coil spring connected between said first coil spring connection point and said second coil spring connection point, said spring exerting a force less than needed to cause said sliding switch to move when said ball is in one of said detents, but sufficient to cause said sliding switch to move to a desired groove end position when said ball is received by said groove and no external force is imparted upon said sliding switch plate, whereby said sliding switch plate may be manually moved to any detent, which detent will hold said switch at such detent position, and said sliding switch plate may be manually moved from any detent to said groove, which groove allows said sliding switch plate to be manually moved in said groove to an opposite groove end position and is spring loaded to return to said desired groove end position when no external force is imparted; and e) a perimeter face plate attached to said base plate to hold said sliding switch plate onto said base plate.

* * * * *